US009830922B2

(12) United States Patent
Chen et al.

(10) Patent No.: US 9,830,922 B2
(45) Date of Patent: Nov. 28, 2017

(54) AUDIO OBJECT CLUSTERING BY UTILIZING TEMPORAL VARIATIONS OF AUDIO OBJECTS

(71) Applicant: DOLBY LABORATORIES LICENSING CORPORATION, San Francisco, CA (US)

(72) Inventors: Lianwu Chen, Beijing (CN); Lie Lu, San Francisco, CA (US); Dirk Jeroen Breebaart, Ultimo (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/117,647

(22) PCT Filed: Feb. 23, 2015

(86) PCT No.: PCT/US2015/017144

§ 371 (c)(1),
(2) Date: Aug. 9, 2016

(87) PCT Pub. No.: WO2015/130617

PCT Pub. Date: Sep. 3, 2015

(65) Prior Publication Data

US 2016/0358618 A1 Dec. 8, 2016

Related U.S. Application Data

(60) Provisional application No. 61/953,338, filed on Mar. 14, 2014.

(30) Foreign Application Priority Data

Feb. 28, 2014 (CN) ..... 2014 1 0078314

(51) Int. Cl.
*G10L 19/20* (2013.01)
*G10L 25/21* (2013.01)
(Continued)

(52) U.S. Cl.
CPC ..... *G10L 19/20* (2013.01); *G10L 19/022* (2013.01); *G10L 25/03* (2013.01); *G10L 25/21* (2013.01); *G10L 25/48* (2013.01); *H04S 7/30* (2013.01)

(58) Field of Classification Search
None
See application file for complete search history.

(56) References Cited

U.S. PATENT DOCUMENTS 9,218,821 B2 12/2015 Lu
2011/0249821 A1 10/2011 Jaillet
(Continued)

FOREIGN PATENT DOCUMENTS

WO 2006/095292 9/2006
WO 2008/063034 5/2008
(Continued)

OTHER PUBLICATIONS

Sadjadi, S. O. et al "A Scanning Window Scheme Based on SVM Training Error Rate for Unsupervised Audio Segmentation" 18th European Signal Processing Conference, Aalborg, Denmark, Aug. 23-27, 2010, pp. 1262-1266.
(Continued)

*Primary Examiner* — Curtis Kuntz
*Assistant Examiner* — Kenny Truong

(57) ABSTRACT

Embodiments of the present invention relate to audio object clustering by utilizing temporal variation of audio objects. There is provided a method of estimating temporal variation of an audio object for use in audio object clustering. The method comprises obtaining at least one segment of an audio track associated with the audio object, the at least one segment containing the audio object; estimating variation of the audio object over a time duration of the at least one segment based on at least one property of the audio object
(Continued)

and adjusting, at least partially based on the estimated variation of the audio object, a contribution of the audio object to the determination of a centroid in the audio object clustering. Corresponding system and computer program product are disclosed.

21 Claims, 2 Drawing Sheets

(51) Int. Cl.

| | |
|---|---|
| ***G10L 19/022*** | (2013.01) |
| ***G10L 25/48*** | (2013.01) |
| ***G10L 25/03*** | (2013.01) |
| ***H04S 7/00*** | (2006.01) |

(56) References Cited

U.S. PATENT DOCUMENTS

2012/0095755 A1* 4/2012 Otani ..... G10L 21/0208 704/205
2013/0077631 A1 3/2013 Lee
2013/0329922 A1* 12/2013 Lemieux ..... H04S 3/002 381/307
2014/0023196 A1 1/2014 Xiang
2014/0350944 A1* 11/2014 Jot ..... G10L 19/008 704/500
2015/0332680 A1 11/2015 Crockett

FOREIGN PATENT DOCUMENTS

| | | |
|---|---|---|
| WO | 2008/111773 | 9/2008 |
| WO | 2011/160850 | 12/2011 |
| WO | 2012/125855 | 9/2012 |

OTHER PUBLICATIONS

Tsingos, N. et al "Perceptual Audio Rendering of Complex Virtual Environments" ACM Transactions on Graphics, vol. 23, No. 3, Aug. 1, 2004, pp. 1-10.

* cited by examiner

AUDIO OBJECT CLUSTERING BY UTILIZING TEMPORAL VARIATIONS OF AUDIO OBJECTS

CROSS-REFERENCE TO RELATED APPLICATIONS

This application claims priority to Chinese Patent Application No. 201410078314.3 filed 28 Feb. 2014 and U.S. Provisional Priority Application No. 61/953,338 filed Mar. 14, 2014, which is hereby incorporated by reference in its entirety.

TECHNOLOGY

Embodiments of the present invention generally relate to audio object clustering, and more specifically, to methods and systems for utilizing temporal variations of audio objects in audio object clustering.

BACKGROUND

Traditionally, audio content is created and stored in channel-based formats. As used herein, the term "audio channel" or "channel" refers to the audio content that usually has a predefined physical location. For example, stereo, surround 5.1, 7.1 and the like are the channel-based formats of audio content. Recently, several conventional multichannel systems have been extended to support a new format that includes both channels and audio objects. As used herein, the term "audio object" or "object" refers to an individual audio element that exists for a defined duration of time in the sound field. An audio object may be dynamic or static. For example, audio objects may be human, animals or any other elements serving as sound sources. Audio objects and channels may be sent separately, and then used by a reproduction system on the fly to recreate the artistic intent adaptively based on configurations of the playback devices. As an example, in a format known as "adaptive audio content," there may be one or more audio objects and one or more "channel beds" which are channels to be reproduced in predefined, fixed locations.

Object-based audio content represents a significant improvement over traditional channel-based audio content. That is, object-based audio content creates a more immersive sound field and controls discrete audio elements accurately, irrespective of specific configurations of the playback devices. For example, cinema sound tracks may comprise many different sound elements corresponding to the images on the screen, dialog, noises, and sound effects that emanate from different places on the screen and combine with background music and ambient effects to create the overall auditory experience.

However, the large number of audio signals (channel beds and audio objects) in object-based audio content poses new challenges for coding and distribution of the audio content. It would be appreciated that in many cases such as distributions via Blue-ray disc, broadcast (cable, satellite and terrestrial), mobile networks, over-the-top (OTT) or the Internet, the bandwidth and/or other resources available for transmitting and processing all the channel beds, audio objects and relevant information may be limited. Although audio coding and compression technologies may be applied to reduce the amount of information to be processed; they do not work in some cases especially for those complexity scenes and networks with very limited bandwidth like mobile networks. Moreover, audio coding/compression technologies are only capable of reducing the bit rate by considering the redundancy within mono channel or channel pairs. That is, various types of spatial redundancy (e.g., the spatial position overlap and spatial masking effect among the audio objects), are not taken into account in the object-based audio content.

Clustering has been proposed to process audio objects such that each resulting cluster may represent one or more audio objects. That is, a clustering process applied to the audio objects to makes use of spatial redundancy to further reduce the resource requirements. Usually, a cluster may contains/combines several audio objects that are proximate enough to each other (the channel beds may be processed as special audio objects with predefined positions.) Generally speaking, in the audio object clustering, several fundamental criteria should be taken into account. For example, the spatial characteristics of the original content should be accurately characterized and modeled in order to maintain the overall spatial perception. Moreover, the audible artifacts or any other issues/challenges for the subsequent processes should be avoided in the clustering process. Currently, audio object clustering involves clustering performed on the basis of individual frames. For example, centroids of the clustering are separately determined for each frame, without considering variations of the audio objects over the time. As a result, the inter-frame stability of the clustering process is relatively low, which is likely to introduce the risk of audible artifacts when rendering the audio object clusters.

In view of the foregoing, there is a need in the art for a solution enabling more stable clustering of audio objects.

SUMMARY

In order to address the foregoing and other potential problems, the present invention proposes a method and system for audio object clustering.

In one aspect, example embodiments of the present invention provide a method for penalizing temporal variation of an audio object in audio object clustering. The method comprises obtaining at least one segment of an audio track associated with the audio object, the at least one segment containing the audio object, estimating variation of the audio object over a time duration of the at least one segment based on at least one property of the audio object and adjusting, at least partially based on the estimated variation, a contribution of the audio object to the determination of a centroid in the audio object clustering. Embodiments in this regard further comprise a corresponding computer program product.

In another aspect, example embodiments of the present invention provide a system for penalizing temporal variation of an audio object in audio object clustering. The system comprises a segment obtaining unit configured to obtain at least one segment of an audio track associated with the audio object, the at least one segment containing the audio object, a variation estimating unit configured to estimate variation of the audio object over a time duration of the at least one segment based on at least one property of the audio object and a penalizing unit configured to adjust, at least partially based on the estimated variation, a contribution of the audio object to the determination of a centroid in the audio object clustering.

Through the following description, it would be appreciated that in accordance with example embodiments of the present invention, temporal variation of the audio objects will be estimated and taken into account when clustering the audio objects. For example, by determining the clustering centroids mainly depending on those audio objects with relatively small temporal variations, it is possible to significantly improve the stability of the object-to-cluster allocations across frames. That is, the centroids of the clustering can be selected in a more stable and consistent manner. As a result, audible artifacts can be avoided in the processed audio signal.

DESCRIPTION OF DRAWINGS

Through the following detailed description with reference to the accompanying drawings, the above and other objectives, features and advantages of embodiments of the present invention will become more comprehensible. In the drawings, several embodiments of the present invention will be illustrated in an example and non-limiting manner, wherein.

Throughout the drawings, the same or corresponding reference symbols refer to the same or corresponding parts.

DESCRIPTION OF EXAMPLE EMBODIMENTS

Figure 1:
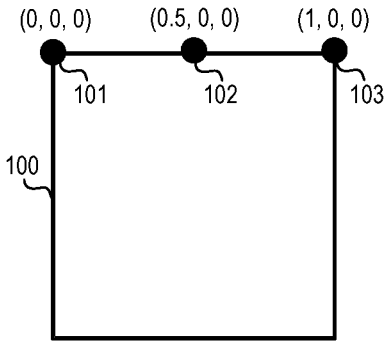
FIG. 1 illustrates a schematic diagram of the instability issue in known audio object clustering process.

Principles of the present invention will now be described with reference to various example embodiments illustrated in the drawings. It should be appreciated that depiction of these embodiments is only to enable those skilled in the art to better understand and further implement the present invention, not intended for limiting the scope of the present invention in any manner.

As discussed above, in the known solutions for audio object clustering, the object-to-cluster allocation is sometimes unstable. As used herein, the stable allocation means that the audio objects (at least for those static objects) are consistently allocated to the centroids with the same positions. For an audio object with fixed position, the object-to-cluster allocation is generally determined by the positions of selected centroids. If the positions of the selected centroids are relatively stable, the object-to-cluster allocation would be stable as well. On the contrary, if the cluster centroid moves or jumps from one position to another position frequently or rapidly, the stability of object-to-cluster allocation across frames would probably be decreased and thus some audible artifacts would be introduced.

FIG. 1 shows an illustrative example of the instability in a known audio object clustering process. In the shown example, two clusters are used to represent three audio objects 101, 102 and 103 in a room 100, where the audio object 101 is in the front left of a room 100, the audio object 103 is in the front right of the room 100 and the audio object 102 is in the front middle of the room 100. In this case, each audio object is associated with an importance value which indicates the perceptual importance of the respective audio object in the audio content. Assume that the importance values for the audio objects 101 and 103 are 1 and 1.5, respectively, and the importance value for the audio object 102 ranges from 0.5 to 1.3. Based on the perceptual criteria, the audio object 103 will be always selected as a centroid, and the other centroid will switch between the audio objects 101 and 102. As such, the audio object 101 will switch between the cluster with the centroid of (0, 0, 0) and the cluster with the centroid of (0.5, 0, 0). As a result, the perceived position of the audio object 101 will jump between the front left and the front center of the room 100, which is very likely to introduce audible artifacts in the processed audio signal.

In order to stabilize the object-to-cluster allocation, according to example embodiments of the present invention, temporal variations of individual audio objects are estimated when determining the clustering centroids. In accordance with example embodiments of the present invention, the temporal variation may be estimated based on one or more relevant properties of the audio object. Then the audio objects that have relatively small temporal variations across the frames may be assigned with higher probability of being selected as the clustering centroids than those with large temporal variations, for example. By penalizing the temporal variations, in accordance with example embodiments of the present invention, the clustering centroids can be selected in a more stable and consistent way. Accordingly, the object-to-cluster allocation and the inter-frame stability can be improved.

Figure 2:
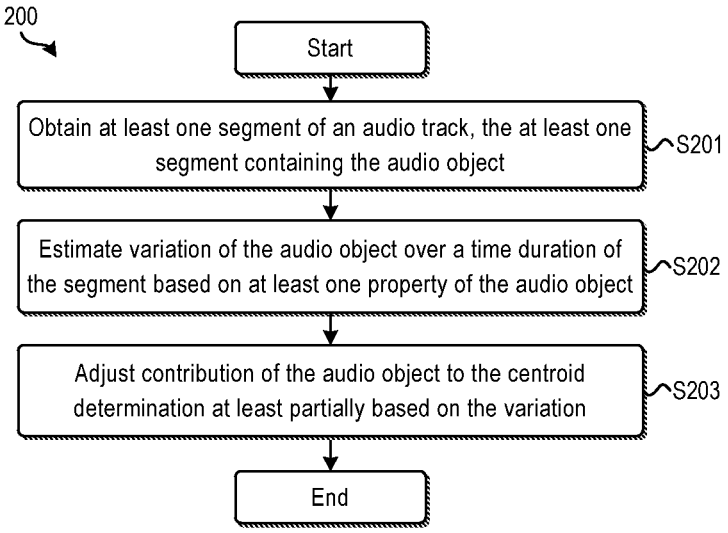
FIG. 2 illustrates a flowchart of a method for utilizing temporal variation of an audio object in audio object clustering in accordance with example embodiments of the present invention.

Reference is now made to FIG. 2 which shows the flowchart of a method 200 for utilizing temporal variation of an audio object in audio object clustering in accordance with example embodiments of the present invention.

As shown, at step S201, at least one segment of an audio track associated with the audio object is obtained, such that the obtained segment(s) contains the audio object being processed. As known, an object track may contain one or more audio objects. In order to accurately estimate the temporal variation of each object, in some example embodiments, the audio track may be segmented into a plurality of segments, each of which is composed of one or more frames. Ideally but not necessarily, each resulting segment contains a single audio object.

In some example embodiments, the audio track may be segmented based on consistency of features of audio objects. In these embodiments, it is supposed that the features (for example, spectrum) of an entire audio object are consistent, while the features of different audio objects are different from each other in most cases. Accordingly, segmentation based on the feature consistency may be applied to divide the audio track into different segments, with each segment containing a single audio object. As an example, in some example embodiments, one or more time stamp may be selected within the audio track. For each time stamp t, the consistency of a given feature(s) may be measured by comparing values of the feature in two time windows before and after the time stamp t. If the measured feature consistency is below a predefined threshold, a potential boundary is detected at the time stamp. Example metrics for measuring the feature consistency between two windows include, but not limited to, Kullback-Leibler Divergence (KLD), Bayesian Information Criteria (BIC), and several simple metrics such as Euclidean distance, cosine distance and Mahalonobis distance.

Additionally or alternatively, in some example embodiments, the segmentation of the audio track may be done based on one or more perceptual properties of the audio objects. As used herein, a "perceptual property" of an audio object refers to a property capable of indicating the level of perception of the audio object. Examples of the perceptual property include, but not limited to, loudness, energy, perceptual importance of the audio objects. As used herein, the "perceptual importance" is used to measure the importance of audio objects in terms of perception when rendering the audio content. For example, in some embodiments, metrics for quantifying the perceptual importance of an audio object may include, but are not limited to partial loudness, and/or semantics (audio types). Partial loudness refers to the perceived loudness metric by considering spatial masking effect of other audio objects in the audio scene. Semantics may be used to indicate the audio content type (such as dialogue, music) of an audio object. The perceptual importance may be determined in any other suitable manners. For example, it may be specified by the user and/or defined in the metadata associated with the audio content.

Only for the purpose of illustration, loudness will be discussed as an example of the perceptual property. In an audio track containing audio objects, it is observed that the audio objects are usually sparse. In other words, there is usually a pause/silence between two adjacent audio objects. Therefore, in some example embodiments, it is possible to detect silence and then divide the audio track into segments based on the detected silence. To this end, loudness of each frame of the audio track may be calculated. Then for each frame, the calculated loudness is compared to a threshold to make the silence/non-silence decision. In some example embodiments, a smoothing process may be applied to the obtained silence/non-silence results. For example, a non-silence frame may be smoothed as silence frame if both the previous and next frames are silence. Next, continuous non-silence frames may be grouped together to form segments containing respective audio objects.

Alternatively or additionally, the audio track may be segmented based on one or more predefined time windows. A predefined time window has a certain length (for example, one second.) Segmentation based on the predefined time windows may provide rough results, for example, a long audio object may be divided into several segments or an obtained segment may contain different audio objects, but could still provide some valuable information for temporal variation estimation. Another advantage is that it is only necessary to apply a short look-ahead window without introducing any additional computation.

It should be noted that the example embodiments as discussed above are only for the purpose of illustration without limiting the scope of the invention. In accordance with example embodiments of the present invention, the audio track may be divided into segments containing respective audio objects with various segmentation technologies, no matter currently known or developed in the future. Moreover, depending on different applications and requirements, these segmentation methods can be used in any combination. Furthermore, in some alternative embodiments, the segments containing audio objects may be provided by an end user, without reliance on the segmentation process.

The method 200 then proceeds to step S202, where the variation of the audio object over the time duration of the obtained segment is estimated based on at least one property of the audio object.

In accordance with example embodiments of the present invention, various properties of the audio object may be used to estimate the temporal variation. For example, in some example embodiments, the temporal variation may be estimated based on one or more perceptual properties of the audio object. As described above, perceptual properties may include loudness, energy, perceptual importance, or any other properties that may indicate the level of perception of the audio object. In accordance with example embodiments of the present invention, the temporal variation of an audio object may be determined by estimating the discontinuity of the perceptual property of the audio object over the time duration of the associated segment.

As an example, in some embodiments, it is possible to estimate the discontinuity of the audio object's loudness which indicates the changing degree of loudness over time. As known, the loudness may serve as a principal factor for measuring the perceptual importance on which the selection of clustering centroids depends. Audio objects with large loudness discontinuity would probably result in the switch of clustering centroid. That is, at this point, the selected centroid is likely to jump from one place to another. This would probably reduce the stability of the object-to-cluster allocation. It should be noted that in the context of the present invention, the loudness includes both the full-band loudness and partial loudness which takes into account the masking effects among the audio objects.

One or more measurable metrics may be used to characterize the loudness discontinuity of an audio object. For example, in some embodiments, dynamic range of the loudness may be calculated. The dynamic range of the loudness indicates the range between the minimum value and the maximum value of the loudness within the time duration of the segment. In some example embodiments, the dynamic range of the loudness may be calculated as follows:

$$r = \frac{(i_{max} - i_{min})}{i_{max}}$$

where $i_{max}$ and $i_{min}$ represent the maximum and minimum values of the loudness within the time duration of the audio segment, respectively.

Additionally or alternatively, in some example embodiments, the estimation of loudness discontinuity may include estimating the transition frequency of the perceptual property over the time duration. The transition frequency (denoted as f) indicates the average times that the loudness value transits from peak to valley or from valley to peak within the unit duration (for example, one second.) In some example embodiments, the frames with loudness greater than $i_{max}-\alpha*(i_{max}-i_{min})$ may be regarded as peaks, while the frames with loudness below $i_{min}+\alpha*(i_{max}-i_{min})$ may be regarded as valleys, where a represents a predefined parameter which may be set as $\alpha=0.1$ in some example embodiments. Suppose T indicates the times of loudness transition between peak and valley within the unit duration. The transition frequency f (with a value between 0 and 1) may be calculated by a sigmoid function as follows:

$$f = \frac{1}{1 + e^{a_f * T + b_f}}$$

where $a_f$ and $b_f$ represent predefined parameters of the sigmoid function.

In accordance with example embodiments of the present invention, the metrics such as the dynamical range and transition frequency may be used either alone or in combination. For example, in some embodiments, the value of dynamic range r or the transition frequency f of the loudness may be directly used as the estimated value of the loudness discontinuity. Alternatively, these metrics may be combined in some embodiments. For example, the loudness discontinuity of the audio object may be calculated based on the dynamic range r and transition frequency f as follows:

$$d=F_d(r,f)$$

where $F_d$ represents a monotonically increasing function with regard to the loudness dynamic range r and loudness transition frequency f. As another example, in some alternative embodiments, the loudness discontinuity may be simply the multiplication of the loudness dynamic range r and loudness transition frequency f:

$$F_d(r,f)=r*f$$

In should be noted that in addition to or instead of the dynamic range and transition frequency, other metrics may be estimated to characterize the loudness discontinuity. For example, a high-order statistics (such as the standard deviation) of the loudness over the time duration of the segment may be estimated in some embodiments. Moreover, it should be noted that the discontinuity estimation as described above is also applicable to any other perceptual properties like the energy and perceptual importance of the audio objects.

In accordance with example embodiments of the present invention, the estimation of temporal variation for the audio object may also include estimating the spatial velocity of the audio object over the time duration of the associated audio segment. It would be appreciated that the spatial velocity may indicate the moving speed of the audio object in the space, where the movement of the audio object may be either continuous movement or discontinuous jump. Generally speaking, from the perspective of inter-frame stability, it would be beneficial to select those audio objects with lower spatial velocity as centroids in the audio object clustering.

Specifically, it is known that in the object-based audio content, the spatial position of an audio object at each time stamp may be described in the metadata. Therefore, in some example embodiments, the spatial velocity of the audio object may be calculated based on the spatial information described in the metadata. For example, suppose $[p_1, p_2, \ldots p_N]$ are the spatial positions of an audio object at the time stamps $[t_1, t_2, \ldots t_N]$, respectively. The spatial velocity of the audio object may be calculated as follows:

$$v_0 = \frac{\sum_{i=1}^{N-1} |p_{i+1} - p_i|}{\sum_{i=1}^{N-1} |t_{i+1} - t_i|}$$

where N represents the number of time stamps within the audio segment. In some example embodiments, a sigmoid function may be used to normalize the spatial velocity into a value ranging in [0, 1], for example, as follows:

$$v = \frac{1}{1 + e^{a_v * v_0 + b_v}}$$

where $a_v$ and $b_v$ represent predefined parameters of the sigmoid function.

In accordance with example embodiments of the present invention, different kinds of temporal variation metrics, such as the discontinuity of the perceptual property and spatial velocity, may be used separately to control the audio object clustering. Alternatively, in some other embodiments, different temporal variation metrics may be combined to represent the overall temporal variation of the audio object within the time duration of the associated segment. In some example embodiments, the overall temporal variation of an audio object may be a linear weighted sum of different variation metrics as follows:

$$V_{all} = \sum_{k=1}^{K} \alpha_k * V_k$$

where K represents the number of kinds of temporal variation metrics, $V_k$ represents the k-th variation metrics, and $\alpha_k$ represents the corresponding weight. Specifically, as an example, the discontinuity of the perceptual property d and spatial velocity v of the audio object may be combined in the following way:

$$V_{all}=\alpha_1*d+\alpha_2*v$$

In some example embodiments, both of the weights $\alpha_1$ and $\alpha_2$ may be set as 0.5. Any other appropriate values are also possible.

Continuing reference to FIG. 2, at step S203, the audio object is penalized by adjusting the audio object clustering process at least partially based on the temporal variation as estimated at step S202. More specifically, in accordance with example embodiments of the present invention, the estimated temporal variation may be used to adjust contribution of the associated audio object to the determination of a centroid in the clustering process.

For example, the estimated temporal variation may be used to adjust the probability that the audio object is selected as a centroid in the audio object clustering. In some example embodiments, it is possible to use "hard penalty" which means that the audio object with large temporal variation will be directly excluded from being selected as a centroid in the clustering. In such embodiments, the variation estimated at step S202 is compared to a predefined variation threshold. If it is determined that the estimated variation is greater than the variation threshold, then the associated audio object will be excluded from being selected as a clustering centroid. In other words, the probability that the audio object is selected as a clustering centroid will be directly set to zero.

In some example embodiments, in addition to the estimated temporal variation of the audio object, one or more other constraints may be taken into account in the hard penalty. For example, in some embodiments, a constraint may be that at least one audio object within a predefined proximity of the audio object being considered is not excluded from being selected as a centroid in the audio object clustering. In other words, a given audio object could be excluded only if at least one audio object near the given audio object remains eligible for centroid selection. In this way, it is possible to avoid large spatial error when rendering the excluded audio object. In some example embodiments, the proximity or "tolerable" maximum distance may be defined in advance.

Alternatively or additionally, in some example embodiments, a constraint that may be used in the hard penalty may be that if a given audio object is not selected as a clustering centroid in a previous frame of the audio segment, then the given audio object could be excluded from the centroid selection. This would be beneficial to the stability of the centroid selection because if the audio object that is selected as a centroid in previous frame is directly excluded in the current frame, the object-to-cluster allocation may be instable.

In accordance with example embodiments of the present invention, many other constraints and factors may be taken into account in the hard penalty of the audio object. In addition, various thresholds used in the penalty may be dynamically adjusted, for example. Moreover, it is also possible to make the hard penalty further based on the complexity of scene, which will be discussed later.

Instead of the hard penalty, at step S203, the "soft penalty" may be applied in some example embodiments. More specifically, it is known that the perceptual importance of individual audio objects make sense to the selection of the clustering centroids. That is, the contribution of an audio object to the determination of centroid may be determined at least partially based on the perceptual importance of that audio object. As described above, perceptual importance may be determined by various metrics including, but not limited to, partial loudness, semantics, user input and so forth. Accordingly, in some example embodiments, the soft penalty may be performed by modifying the perceptual importance of the audio object based on the variation of the audio object as estimated at step S202.

To calculate the modified perceptual importance, in some example embodiments, a gain which is determined based on the estimated temporal variation may be applied to the original perceptual importance of the audio object. For example, the gain may be multiplied with the original perceptual importance. In general, the gain decreases as the temporal variation increases (that is, with high penalty). In some example embodiments, the gain (denoted as g) may be calculated as:

$$g=F_g(V)$$

where V represents the estimated temporal variation of the audio object, and $F_g$ represents a monotonically decreasing function with regard to V. In some example embodiments, the function $F_g$ may be defined as follows:

$$F_g(V)=\frac{1}{1+P_0*V}$$

where $P_0$ represents a predefined parameter indicating the penalty degree for the temporal variation. It would be appreciated that in these embodiments, when the penalty degree $P_0$ is very small, the calculated gain approximates to 1 irrespective of the temporal variation. It means that the temporal variation has little influence on the importance estimation. To the contrary, when the penalty degree is relatively large, the modified perceptual importance will highly relate to the value of temporal variation.

In addition to or instead of adjusting the probability of the audio object in the centroid selection, the temporal variations may be otherwise penalized, for example, by adjusting contributions of audio objects to the update of centroid in the clustering process. For example, the audio objects may be clustered by K-means clustering algorithms or the like where there is no explicit process of selecting audio objects as centroids or the centroids are not fixed at the positions of audio objects. In this event, the estimated temporal variations are still capable of controlling the clustering process, for example, by adjusting contribution of associated audio objects to the centroid updates. For example, the soft penalty may be combined with the clustering process. Initially, one or more centroids may be determined in various ways such as random selection, furthest-apart criteria, or the like. Next, each audio object may be allocated to a cluster associated with the closest centroid. Then each of the centroids may be updated based on the weighted average of the audio objects allocated to the cluster, where the weight for each audio object is the perceptual importance thereof. This process may be repeated until the convergence. As described above, in some example embodiments, the estimated temporal variation may be used to adjust the perceptual importance of the audio object. As such, for each audio object, the temporal variation is taken into account when determining the contribution of the audio object to the centroid update.

It should be noted that all the features discussed above with respect to the centroid selection are applicable to the centroid update as well. For example, in some embodiments, the hard penalty may also be used where the audio object with a variation greater than a predefined threshold may be excluded from the update of centroid. Moreover, one or more constraints may be applied in combination with the temporal variations. For example, one example constraint may be that an audio object with high temporal variation could be excluded if at least one audio object within a predefined proximity of that audio object is not excluded from the determination of centroid (for example, the update of centroid). Another example constraint may be that an audio object with high temporal variation could be excluded if that audio object has also been excluded from the determination of centroid (for example, the update of centroid) in a previous frame(s) of the segment.

In accordance with example embodiments of the present invention, in addition to the estimated variation of the audio object, other factors may be considered in penalizing the object variation at step S203. For example, in some embodiments, complexity of the scene associated with the audio object may be taken into account. More specifically, it is observed that for some audio contents with low scene complexity, selecting audio objects with high temporal variation as centroid may not cause instability issue. The variation-based penalty in this case, however, might increase the spatial error of the audio object clustering. For example, for the audio content with five input audio objects and five output clusters, it is unnecessary to penalize the temporal variations of the audio objects since the problem can be addressed without extra processing. As another example, if there are two clusters for five audio objects where one audio object is moving and the other four stay at the same/close positions, it is unnecessary to penalize the moving audio object because the moving audio object may be assigned into one cluster while and the other four audio objects may be grouped into another cluster.

In order to avoid the unnecessary penalty of temporal variation, in some example embodiments, the scene complexity may be determined, for example, according to the number of audio objects in the scene, the number of output clusters, the distribution of audio objects in the scene, the movement of audio objects, and/or any other relevant factors. Then, at step S203, the audio object may be penalized based on not only the estimated temporal variation but also the scene complexity. That is, the contribution of the audio object to the determination of centroid may be adjusted based on the estimated temporal variation of the audio object as well as the determined complexity of scene.

In general, in accordance with example embodiments of the present invention, the temporal variation penalty may be applied to the audio contents with relatively high scene complexity (for which the centroid instability matters), instead of those audio contents with lower scene complexity.

In other word, the scene complexity may be used as an indication about the possibility of introducing potential issues when the clustering centroids are unstable. Specifically, the penalty based on the scene complexity may be used in connection with the hard penalty, soft penalty or the combination thereof.

As described above, one or more constraints may be combined with the estimated temporal variations in the hard penalty. In some example embodiments, a constraint(s) related to the scene complexity may be added when deciding whether to exclude a given audio object from the centroid determination. For example, one such constraint may be that the scene complexity of the audio content should larger than a predefined threshold. In other words, only when the audio object is associated with a scene of high complexity, the excluding of the audio object from the centroid determination is activated.

It is also possible to combine the scene complexity with the soft penalty of the audio object. In some example embodiments, in the soft penalty of the audio object, penalty degree used for modifying the estimated perceptual importance may be correlated with the scene complexity. For example, the penalty degree, denoted as P(SC), may be defined as a monotonically increasing function with regard to the scene complexity denoted as SC, for example, as follows:

$$P(\mathrm{SC})=P_0*\mathrm{SC}$$

where $P_0$ represents a predefined parameter which indicate the penalty degree for the temporal variation. Accordingly, in these embodiments, the gain g that is used to adjust the original perceptual importance of the audio object may be adapted as:

$$g=\frac{1}{1+P(SC)*V}$$

where V represents the estimated variation of the audio object.

Figure 3:
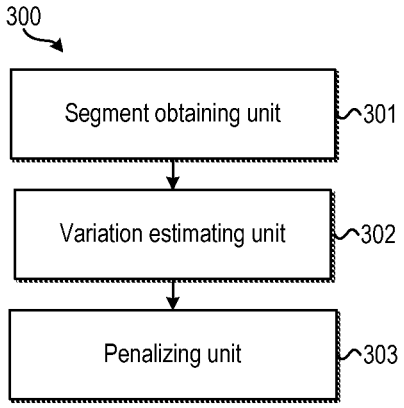
FIG. 3 illustrates a block diagram of a system for utilizing temporal variation of an audio object for use in audio object clustering in accordance with example embodiments of the present invention.

FIG. 3 shows a block diagram of a system 300 for utilizing temporal variation of an audio object in audio object clustering. As shown, the system 300 comprises: a segment obtaining unit 301 configured to obtain at least one segment of an audio track associated with the audio object, the at least one segment containing the audio object; a variation estimating unit 302 configured to estimate variation of the audio object over a time duration of the at least one segment based on at least one property of the audio object; and a penalizing unit 303 configured to adjust, at least partially based on the estimated variation, a contribution of the audio object to the determination of a centroid in the audio object clustering.

In some example embodiments, the segment obtaining unit 301 may comprise a segmentation unit (not shown) which is configured to segment the audio track based on at least one of: consistency of a feature of the audio object; a perceptual property of the audio object that indicates a level of perception of the audio object; and a predefined time window.

In some example embodiments, the at least one property of the audio object includes a perceptual property of the audio object that indicates a level of perception of the audio object. In these embodiments, the variation estimating unit 302 may comprise a discontinuity estimating unit (not shown) which is configured to estimate discontinuity of the perceptual property over the time duration of the at least one segment. Specifically, in some example embodiments, the discontinuity estimating unit may be configured to estimate at least one of: a dynamic range of the perceptual property over the time duration; a transition frequency of the perceptual property over the time duration; and a high-order statistics of the perceptual property over the time duration.

In some example embodiments, the perceptual property of the audio object may comprise at least one of: loudness of the audio object; energy of the audio object; and perceptual importance of the audio object.

Alternatively or additionally, in some example embodiments, the variation estimating unit 302 may comprise a velocity estimating unit (not shown) which is configured to estimate a spatial velocity of the audio object over the time duration of the at least one segment.

In some example embodiments, the penalizing unit 303 may be configured to adjust, at least partially based on the estimated variation of the audio object, probability that the audio object is selected as the centroid in the audio object clustering. Alternatively, the penalizing unit 303 may be configured to adjust, at least partially based on the estimated variation, a contribution of the audio object to update of the centroid in the audio object clustering.

In some example embodiments, the system 300 may further comprises a comparing unit (not shown) which is configured to compare the estimated variation to a predefined variation threshold. In these embodiments, the penalizing unit 303 may comprise a hard penalizing unit (not shown) which is configured to exclude, at least partially based on a determination that the estimated variation is greater than the predefined variation threshold, the audio object from the determination of the centroid in the audio object clustering. In some example embodiments, the excluding of the audio object may be further based on a set of constraints. For example, the set of constraints may include at least one of: the audio object could be excluded if at least one audio object within a predefined proximity of the audio object is not excluded from the determination of the centroid in the audio object clustering; and the audio object could be excluded if the audio object has been excluded from the determination of the centroid in the audio object clustering in a previous frame of the at least one segment.

In some example embodiments, the contribution of the audio object to the determination of the centroid may be determined at least partially based on estimation of perceptual importance of the audio object. In these embodiments, the penalizing unit 303 may comprise a soft penalizing unit (not shown) which is configured to modify the perceptual importance of the audio object based on the estimated variation of the audio object.

In some example embodiments, the system 300 may further comprise a scene complexity determining unit (not shown) which configured to determine complexity of a scene associated with the audio object. In these embodiments, the penalizing unit 303 may be configured to adjust the contribution of the audio object based on both the estimated variation of the audio object and the determined complexity of the scene. Specifically, in some example embodiments, the scene complexity determining unit may be configured to determine the complexity of the scene based on at least one of the number of audio objects in the scene, the number of output clusters, and the distribution of audio objects in the scene.

It should be noted that for the sake of clarity, some optional units of the system 300 are not shown in FIG. 3. However, it should be appreciated that the features as described above with reference to FIG. 2 are as well applicable to the system 300. Moreover, the units of system 300 may be hardware modules or software modules. For example, in some example embodiments, the system 300 may be implemented partially or completely with software and/or firmware, for example, implemented as a computer program product embodied in a computer readable medium. Alternatively or additionally, the system 300 may be implemented partially or completely based on hardware, for example, as an integrated circuit (IC), an application-specific integrated circuit (ASIC), a system on chip (SOC), a field programmable gate array (FPGA), and so forth. The scope of the present invention is not limited in this regard.

Figure 4:
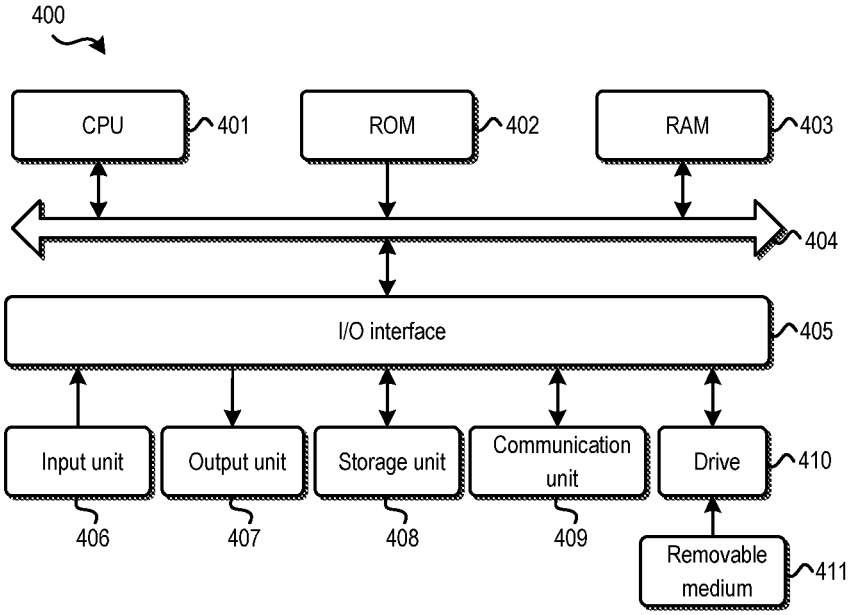
FIG. 4 illustrates a block diagram of an example computer system suitable for implementing example embodiments of the present invention.

FIG. 4 shows a block diagram of an example computer system 400 suitable for implementing example embodiments of the present invention. As shown, the computer system 400 comprises a central processing unit (CPU) 401 which is capable of performing various processes in accordance with a program stored in a read only memory (ROM) 402 or a program loaded from a storage unit 408 to a random access memory (RAM) 403. In the RAM 403, data required when the CPU 401 performs the various processes or the like is also stored as required. The CPU 401, the ROM 402 and the RAM 403 are connected to one another via a bus 404. An input/output (I/O) interface 405 is also connected to the bus 404.

The following components are connected to the I/O interface 405: an input unit 406 including a keyboard, a mouse, or the like; an output unit 407 including a display such as a cathode ray tube (CRT), a liquid crystal display (LCD), or the like, and a loudspeaker or the like; the storage unit 408 including a hard disk or the like; and a communication unit 409 including a network interface card such as a LAN card, a modem, or the like. The communication unit 409 performs a communication process via the network such as the internet. A drive 410 is also connected to the I/O interface 405 as required. A removable medium 411, such as a magnetic disk, an optical disk, a magneto-optical disk, a semiconductor memory, or the like, is mounted on the drive 410 as required, so that a computer program read therefrom is installed into the storage unit 408 as required.

Specifically, in accordance with example embodiments of the present invention, the processes described above with reference to FIG. 2 may be implemented as computer software programs. For example, embodiments of the present invention comprise a computer program product including a computer program tangibly embodied on a machine readable medium, the computer program including program code for performing method 200. In such embodiments, the computer program may be downloaded and mounted from the network via the communication unit 409, and/or installed from the removable medium 411.

Generally speaking, various example embodiments of the present invention may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments of the present invention are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, embodiments of the present invention include a computer program product comprising a computer program tangibly embodied on a machine readable medium, the computer program containing program codes configured to carry out the methods as described above.

In the context of the disclosure, a machine readable medium may be any tangible medium that may contain, or store a program for use by or in connection with an instruction execution system, apparatus, or device. The machine readable medium may be a machine readable signal medium or a machine readable storage medium. A machine readable medium may include but not limited to an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the present invention may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any invention or of what may be claimed, but rather as descriptions of features that may be specific to particular embodiments of particular inventions. Certain features that are described in this specification in the context of separate embodiments may also be implemented in combination in a single embodiment. Conversely, various features that are described in the context of a single embodiment may also be implemented in multiple embodiments separately or in any suitable sub-combination.

Various modifications, adaptations to the foregoing example embodiments of this invention may become apparent to those skilled in the relevant arts in view of the foregoing description, when read in conjunction with the accompanying drawings. Any and all modifications will still fall within the scope of the non-limiting and example embodiments of this invention. Furthermore, other embodiments of the inventions set forth herein will come to mind to one skilled in the art to which these embodiments of the invention pertain having the benefit of the teachings presented in the foregoing descriptions and the drawings.

The present invention may be embodied in any of the forms described herein. For example, the following enumerated example embodiments (EEEs) describe some structures, features, and functionalities of some aspects of the present invention.

EEE 1. A method of processing object-based audio data, comprising: determining the temporal variation of one or more audio objects based on object audio data and associated metadata; and combining audio objects into audio clusters by penalizing the determined temporal variation to stabilize the object-to-cluster allocation in audio object clustering.

EEE 2. The method of EEE 1, wherein the audio object tracks are divided into segments/objects.

EEE 3. The method of EEE 2, wherein the segmentation comprising at least one of: pre-define window segmentation; loudness based segmentation; and feature consistency based segmentation.

EEE 4. The method of EEE 1, wherein the temporal variation is based on at least one of: discontinuity of loudness, and spatial velocity.

EEE 5. The method of EEE 4, wherein the temporal variation is further based on the discontinuity of energy, or the discontinuity of perceptual importance comprising at least one of partial loudness and audio type.

EEE 6. The method of EEE 4, wherein the discontinuity of loudness is calculated based on loudness dynamic range and loudness transition frequency.

EEE 7. The method of EEE 4, wherein the spatial velocity is estimated based on metadata of the object.

EEE 8. The method of EEE 1, wherein penalizing temporal variation comprises excluding object from centroid selection, or modifying importance estimation.

EEE 9. The method of EEE 8, wherein objects with large temporal variations are excluded by combining at least one of the following constraints: at least a remaining object near to the excluded object; the object that is selected as centroid in previous frame could not be excluded.

EEE 10. The method of EEE 8, wherein the modified importance of object monotonically decreases as the temporal variation increases.

EEE 11. The method of EEE 1 or EEE 8, wherein the penalizing of the temporal variation is controlled by the scene complexity of the audio content to be clustered.

EEE 12. The method of EEE 1, wherein penalizing the determined temporal variation comprises adjusting a contribution of the associated audio object to the centroid update in the audio object clustering based on the determined temporal variation.

EEE 13. A system of processing object-based audio data, comprising units configured to carry out the method of any of EEEs 1 to 12.

EEE 14. A computer program product of processing object-based audio data, the computer program product being tangibly stored on a non-transient computer-readable medium and comprising machine executable instructions which, when executed, cause the machine to perform steps of the method of any of EEEs 1 to 12.

It will be appreciated that the embodiments of the present invention are not to be limited to the specific embodiments as discussed above and that modifications and other embodiments are intended to be included within the scope of the appended claims. Although specific terms are used herein, they are used in a generic and descriptive sense only and not for purposes of limitation.

What is claimed is:

1. A method for utilizing temporal variation of an audio object in audio object clustering, the method comprising:

determining a plurality of centroids for a plurality of audio object clusters, wherein the plurality of audio object clusters includes a plurality of audio objects, wherein determining the plurality of centroids includes, for each audio object of the plurality of audio objects:

obtaining at least one segment of an audio track associated with the audio object, the at least one segment containing the audio object;

estimating variation of the audio object over a time duration of the at least one segment based on at least one property of the audio object; and adjusting, at least partially based on the estimated variation, a contribution of the audio object to determination of a centroid in the audio object clustering, wherein:

the contribution of the audio object is determined at least partially based on estimation of perceptual importance of the audio object, and adjusting the contribution comprises applying to the perceptual importance of the audio object a gain which decreases as the estimated variation increases; and/or adjusting the contribution of the audio object comprises excluding, at least partially based on a determination that the estimated variation is greater than a predefined variation threshold, the audio object from the determination of the centroid in the audio object clustering; and allocating each audio object of the plurality of audio objects to one of the plurality of audio object clusters according to a closest centroid of the plurality of centroids.

2. The method according to claim 1, wherein obtaining the at least one segment of the audio track comprises segmenting the audio track based on at least one of:

consistency of a feature of the audio object;

a perceptual property of the audio object that indicates a level of perception of the audio object; and a predefined time window.

3. The method according to claim 2, wherein the perceptual property of the audio object comprises at least one of:

loudness of the audio object;

energy of the audio object; and perceptual importance of the audio object.

4. The method according to claim 1, wherein the at least one property of the audio object includes a perceptual property of the audio object that indicates a level of perception of the audio object, and wherein estimating the variation of the audio object comprises:

estimating discontinuity of the perceptual property over the time duration of the at least one segment.

5. The method according to claim 4, wherein estimating the discontinuity of the perceptual property comprises estimating at least one of:

a dynamic range of the perceptual property over the time duration;

a transition frequency of the perceptual property over the time duration; and a high-order statistics of the perceptual property over the time duration.

6. The method according to claim 1, wherein estimating the variation of the audio object comprises:

estimating a spatial velocity of the audio object over the time duration of the at least one segment.

7. The method according to claim 1, wherein adjusting the contribution of the audio object comprises:

adjusting, at least partially based on the estimated variation, probability that the audio object is selected as the centroid in the audio object clustering.

8. The method according to claim 1, wherein the excluding of the audio object is further based on a set of constraints, the set of constraints including at least one of:

the audio object is excluded if at least one audio object within a predefined proximity of the audio object is not excluded from the determination of the centroid; and the audio object is excluded if the audio object has been excluded from the determination of the centroid in a previous frame of the at least one segment.

9. The method according to claim 1, further comprising:

determining complexity of a scene associated with the audio object, wherein the contribution of the audio object is adjusted based on the estimated variation of the audio object and the determined complexity of the scene.

10. The method according to claim 9, wherein the complexity of the scene is determined based on at least one of:

the number of audio objects in the scene;

the number of output clusters; and a distribution of audio objects in the scene.

11. A system for utilizing temporal variation of an audio object in audio object clustering, the system comprising:

a determining unit configured to determine a plurality of centroids for a plurality of audio object clusters, wherein the plurality of audio object clusters includes a plurality of audio objects, wherein the determining unit includes:

a segment obtaining unit configured to obtain at least one segment of an audio track associated with each audio object of the plurality of audio objects, the at least one segment containing the audio object;

a variation estimating unit configured to estimate variation of the audio object over a time duration of the at least one segment based on at least one property of the audio object; and a penalizing unit configured to adjust, at least partially based on the estimated variation, a contribution of the audio object to determination of a centroid in the audio object clustering, wherein:

the system further comprises a comparing unit configured to compare the estimated variation to a predefined variation threshold, and the penalizing unit comprises a soft penalizing unit configured to apply to the perceptual importance of the audio object a gain which decreases as the estimated variation increases; and/or the contribution of the audio object is determined at least partially based on estimation of perceptual importance of the audio object, and the penalizing unit comprises a hard penalizing unit configured to exclude, at least partially based on a determination by the comparing unit that the estimated variation is greater than the predefined variation threshold, the audio object from the determination of the centroid in the audio object clustering; and an allocating unit configured to allocate each audio object of the plurality of audio objects to one of the plurality of audio object clusters according to a closest centroid of the plurality of centroids.

12. The system according to claim 11, wherein the segment obtaining unit comprises a segmentation unit configured to segment the audio track based on at least one of:

consistency of a feature of the audio object;

a perceptual property of the audio object that indicates a level of perception of the audio object; and a predefined time window.

13. The system according to claim 12, wherein the perceptual property of the audio object comprises at least one of:

loudness of the audio object;

energy of the audio object; and perceptual importance of the audio object.

14. The system according to claim 11, wherein the at least one property of the audio object includes a perceptual property of the audio object that indicates a level of perception of the audio object, and wherein the variation estimating unit comprises:

a discontinuity estimating unit configured to estimate discontinuity of the perceptual property over the time duration of the at least one segment.

15. The system according to claim 14, wherein the discontinuity estimating unit is configured to estimate at least one of:

a dynamic range of the perceptual property over the time duration;

a transition frequency of the perceptual property over the time duration; and a high-order statistics of the perceptual property over the time duration.

16. The system according to claim 11, wherein the variation estimating unit comprises:

a velocity estimating unit configured to estimate a spatial velocity of the audio object over the time duration of the at least one segment.

17. The system according to claim 11, wherein the penalizing unit is configured to:

adjust, at least partially based on the estimated variation of the audio object, probability that the audio object is selected as the centroid in the audio object clustering.

18. The system according to claim 17, wherein the excluding of the audio object is further based on a set of constraints, the set of constraints including at least one of:

the audio object is excluded if at least one audio object within a predefined proximity of the audio object is not excluded from the determination of the centroid; and the audio object is excluded if the audio object that has been excluded from the determination of the centroid in a previous frame of the at least one segment.

19. The system according to claim 11, further comprising:

a scene complexity determining unit configured to determine complexity of a scene associated with the audio object, wherein the penalizing unit is configured to adjust the contribution of the audio object based on the estimated variation of the audio object and the determined complexity of the scene.

20. The system according to claim 19, wherein the scene complexity determining unit is configured to determine the complexity of the scene based on at least one of:

the number of audio objects in the scene;

the number of output clusters; and a distribution of audio objects in the scene.

21. A computer program product for utilizing temporal variation of an audio object in audio object clustering, the computer program product being tangibly stored on a non-transient computer-readable medium and comprising machine executable instructions which, when executed, cause the machine to perform steps of the method according to claim 1.

* * * * *